United States Patent [19]

Mottura

[11] Patent Number: 4,838,333

[45] Date of Patent: Jun. 13, 1989

[54] ROLLER BLIND WITH A CENTRIFUGAL-MASS BRAKE LOCATED OUTSIDE THE ROLLER AND AN END SUPPORT CONTAINING THE BRAKE

[75] Inventor: Sergio Mottura, Torino, Italy

[73] Assignee: Mottura S.p.A., Italy

[21] Appl. No.: 181,938

[22] Filed: Apr. 15, 1988

[30] Foreign Application Priority Data

Dec. 17, 1986 [IT] Italy ..... 54213/86[U]

[51] Int. Cl.[4] ..... E06B 9/208

[52] U.S. Cl. ..... 160/305; 160/296; 160/299; 192/12 B; 188/184

[58] Field of Search ..... 160/305, 296, 299, 294, 160/323.1, 309, 903; 192/12 B, 46, 105 CD; 188/184

[56] References Cited

U.S. PATENT DOCUMENTS

| | | | |
|---|---|---|---|
| 1,772,700 | 8/1930 | Bellerose | 160/299 |
| 4,047,441 | 9/1977 | Kellogg | 160/189 X |
| 4,147,197 | 4/1979 | Bailey et al. | 160/7 |
| 4,158,307 | 6/1979 | Schwager | 188/184 X |
| 4,513,805 | 4/1985 | Mase | 160/299 |

*Primary Examiner*—Blair M. Johnson

*Attorney, Agent, or Firm*—Sughrue, Mion, Zinn, Macpeak & Seas

[57] ABSTRACT

A roller blind comprising a horizontal roller for supporting the blind and mounted for rotation about its own axis, a blind having an upper edge fixed to the roller and a free lower edge, resilient means tending to bias the roller towards a position in which the blind is rolled up, and a centrifugal-mass brake for slowing the rotation of the roller during rolling up of the blind. The centrifugal-mass brake is carried by a fixed support structure outside the roller and the rotor of the brake is connected to the roller through the interposition of step-up wheels and a one-way clutch device adapted to break the connection between the rotor of the brake and the roller when the blind is lowered, the one-way clutch device and the step-up wheels also being carried by the fixed support structure, outside the roller.

5 Claims, 1 Drawing Sheet

ROLLER BLIND WITH A CENTRIFUGAL-MASS BRAKE LOCATED OUTSIDE THE ROLLER AND AN END SUPPORT CONTAINING THE BRAKE

DESCRIPTION

The present invention relates to roller blinds of the type comprising a horizontal roller for supporting the blind and mounted for rotation about its own axis, a blind having an upper edge fixed to the roller and a free lower edge, resilient means tending to bias the roller towards a position in which the blind is rolled up, and a centrifugal-mass brake for slowing the rotation of the roller during rolling up of the blind.

According to conventional techniques, the centrifugal-mass brake is located within the roller. As a result, maintenance operations on the brake involve the taking down of the blind and the extraction of the mechanism within the roller. Another problem of this known technique lies in the fact that, upon rewinding of the blind, the roller transmits vibrations to the brake mechanism, which disturb the uniformity of its braking. Finally, it is not possible to intervere quickly on the braking mechanism to adjust it.

The object of the invention is to produce a roller blind of the type indicated at the beginning of the present description, which is able to avoid all the above problems.

The main characteristics of the blind according to the invention lies in the fact that the centrifugal-mass brake is carried by a fixed support structure, outside the roller, and in that the rotor of the brake is connected to the roller through the interposition of step-up wheels and a one-way clutch device adapted to break the connection between the brake rotor and the roller when the blind is lowered, the step-up wheels also being carried by the fixed support structure, outside the roller.

The one-way clutch device has an output shaft for coupling to the roller of the blind, which is easily adaptable to any type of roller. Furthermore, since the centrifugal-mass brake is located outside the roller, maintenance operations on the brake can be carried out easily and rapidly, and it is also possible to provide a device for adjustment of the brake which is easily accessible from outside. Since the brake is not associated with the roller of the blind, there are no problems resulting from vibrations of the roller during rolling up of the blind.

The end support of the roller containing the centrifugal-mass brake is very adaptable to any type of roller.

Further characteristics and advantages of the invention will become clear from the description which follows with reference to the appended drawings, provided purely by way of non-limiting example, in which.

Figure 1:
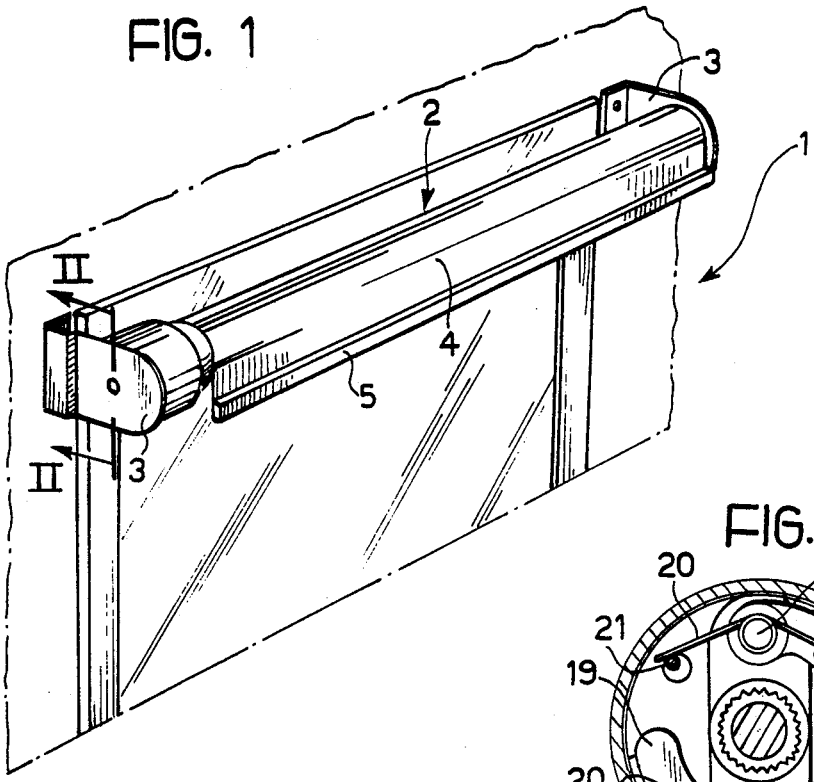
FIG. 1 is a perspective view of a roller blind according to the invention.

FIG. 1 shows a roller blind 1 comprising a horizontal roller 2 for supporting the blind, mounted for rotation about its own axis by means of two brackets 3 screwed to the wall. The sheet of the blind is indicated 4 and has an upper edge (not visible in the drawings) which is fixed to the roller 2 and a free lower edge provided with a stiffening rod 5.

Figure 3:
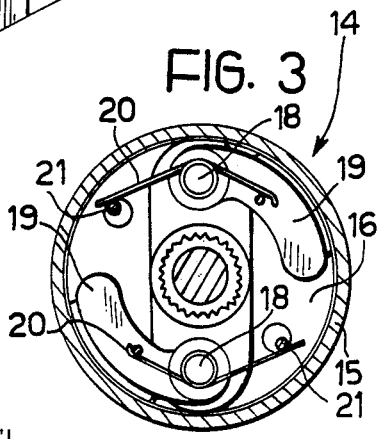
FIG. 3 is a section taken on the line III—III of FIG. 2.
Figure 2:
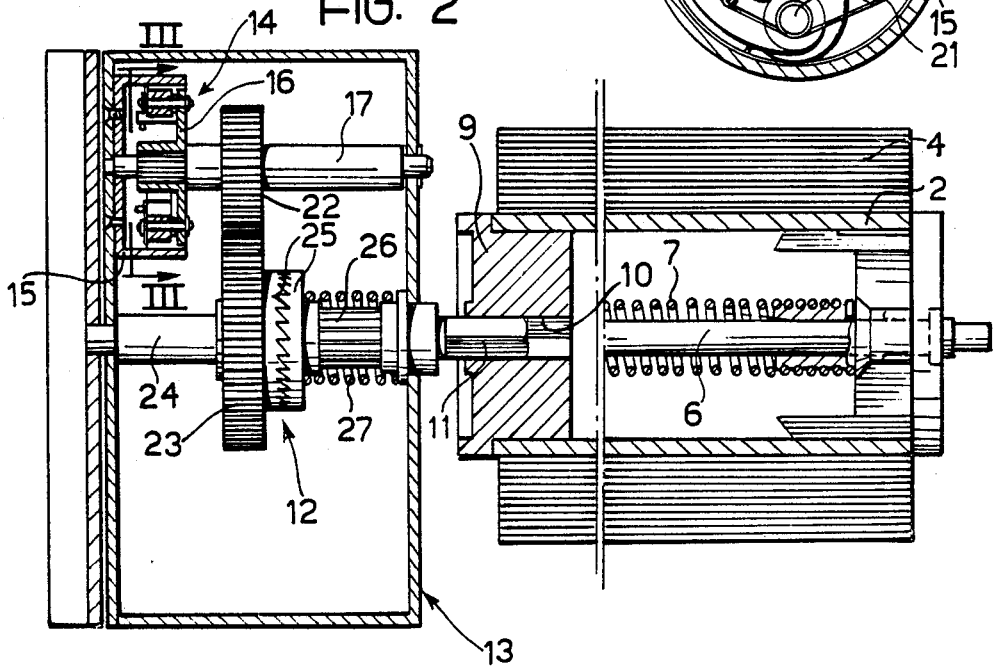
FIG. 2 is a section taken on the line II—II of FIG. 1.

One end of the roller 2 (the right-hand end in FIGS. 1, 3) carries a cylindrical body 9 which is supported for rotation on a shaft 6. Between the body 9 and the shaft 6 is interposed a helical spring 7 tending to bias the roller towards the position in which the blind is rolled up. The shaft 6 ends a certain distance from the end of the tube 2 carrying the cylindrical body 9. One end of the shaft 6, which projects axially from the roller, is indicated at 8 and is intended to be fixed in a corresponding seat of the respective support bracket 3. The usual ratchet gear which enables the blind to be locked in any position against the action of the spring 7 is housed within the body 9. This mechanism is not illustrated in detail in the present description, since it is of known type and does not fall within the scope of the present invention.

The opposite end of the tube 2 is provided with a closure element 5 having an axial cavity 10 of non-circular section, for example, of hexagonal section. A correspondingly-sectioned output shaft 11 of a one-way clutch device 12 situated within a fixed hollow support structure 13 is engaged in the cavity 10.

Within the structure 13 is situated a centrifugal-mass brake 14 including a fixed ring 15 (see also FIG. 3) and a rotor 16 carried by a shaft 17 which is mounted rotatably within the structure 16. Two centrifugal masses 19 are articulated at 18 to the rotor 16 (FIG. 3) and press against the internal surface of the ring 15, due to the centrifugal effect, when the rotor 16 is rotated. A pin spring 20 is associated with each centrifugal mass 19 and tends to keep the centrifugal mass in a position in which it is disengaged from the ring 15 so that, when the rotor is stopped, the centrifugal masses 19 are not in contact with the internal surface of the ring. The loading of the springs 20 can be adjusted by acting on eccentric pins 21. For example, the pins 21 may be carried by screws whose heads are accessible from outside, so as to enable the operator to adjust the brake easily. The shaft 17 carries a gear 22 which meshes with a further gear 23 of larger diameter carried by a shaft 24 mounted rotatably within the structure 13 and coaxial with the output shaft 11. The two shafts 24, 11 are connected to each other by means of the clutch device 12 which comprises two wheels 25 having frontal teeth meshed together, one of which is joined to the shaft 24, while the other is coupled for rotation with the shaft 11 but is axially slidable on a splined portion 26 thereof. A helical spring 27 tends to keep the two wheels meshed together.

When the blind is unrolled, the pair of gears 22, 23 constitute step-up wheels which tend to rotate the rotor 16 of the brake 14 at a fairly high rate. Consequently, at this stage, the centrifugal masses would tend to exert a braking action which would inconveniently impede the action of the operator. The clutch device 12 operates at this stage, however, to enable the output shaft 11 and consequently the roller 2 of the blind to rotate in steps, while the shafts 17, 24 are held in a fixed position by the brake.

When the operator rewinds the blind under the action of the spring 7, however, the clutch device 12 remains in the position in which the shafts 24, 11 are connected, so that the rotor of the brake rotates at a fast rate and exerts the required braking action.

From the preceding description, it is clear that the roller blind according to the invention has the advantage of enabling easy and rapid execution of maintenance and adjustment operations on the brake associated with the blind. Moreover, the output end of the shaft 11 may easily be adapted to any type of roller, a closure element, such as that indicated at 5 in the appended drawings, being provided at the end thereof.

The wheels 22, 23 can easily be replaced to achieve whatever transmission ration is required.

Naturally, the principle of the invention remaining the same, the details of construction may be varied widely with respect to those described and illustrated purely by way of example, without thereby departing from the scope of the invention. For example, the male and female coupling 10, 1 could be reversed.

I claim:

1. A roller blind of the type comprising a horizontal roller for supporting the blind and mounted for rotation about its own axis, a blind having an upper edge fixed to the roller and a free lower edge, resilient means tending to bias the roller towards a position in which the blind is rolled up, and a centrifugal-mass brake for slowing the rotation of the roller during rolling up of the blind, wherein the centrifugal-mass brake is carried by a fixed support structure, outside the roller, and wherein the rotor of the brake is connected to the roller through the interposition of a pair of step-up intermeshing gears and a one-way clutch device adapted to break the connection between the rotor of the brake and the roller when the blind is lowered, the step-up wheels also being carried by the fixed support structure, outside the roller.

2. A roller blind according to claim 1, wherein the centrifugal-mass brake is adjustable.

3. A roller blind according to claim 1, wherein the one-way clutch device is constituted by a pair of wheels having frontal teeth which cooperate with each other and are biassed into engagement with each other by resilient means.

4. A roller blind according to claim 1, wherein the one-way clutch device has an output shaft for coupling with the roller of the blind, having a non-circular section and being mounted in a correspondingly-sectioned cavity of a closure element provided at one end of the roller of the blind.

5. An end support for a roller of a roller blind comprising a fixed support structure, a centrifugal-mass brake including a rotor mounted in said structure, a one-way clutch device mounted in said structure and having an output shaft connected to said roller, and a pair of step-up intermeshing gears mounted in said structure and operably interconnecting said brake and clutch wherein said one-way clutch device is adapted to brake the conection between the rotor of the brake and the output shaft of the clutch when the blind is lowered.

* * * * *